United States Patent [19]

Babin

[11] Patent Number: 5,021,775

[45] Date of Patent: Jun. 4, 1991

[54] SYNCHRONIZATION METHOD AND CIRCUIT FOR DISPLAY DRIVERS

[75] Inventor: David C. Babin, Austin, Tex.

[73] Assignee: Motorola, Inc., Schaumburg, Ill.

[21] Appl. No.: 316,213

[22] Filed: Feb. 27, 1989

[51] Int. Cl.[5] ..... G09G 3/00

[52] U.S. Cl. ..... 340/814; 340/756; 340/802; 340/825.35; 340/800

[58] Field of Search ..... 340/756, 814, 800, 801, 340/802, 825.35, 717

[56] References Cited

U.S. PATENT DOCUMENTS 4,500,880 2/1985 Gomersall et al. ..... 340/825.35

FOREIGN PATENT DOCUMENTS 0221698 5/1987 European Pat. Off. ..... 340/814

OTHER PUBLICATIONS

Motorola Semiconductor Technical Data-MC14489; Motorola, Inc.; Aug. 1988; pp. 1-14.

National Semiconductor Corporation Microcontroller's Data Bank; 1988 Edition; pp. 3-57 to 3-63.

*Primary Examiner*—Alvin E. Oberley

*Attorney, Agent, or Firm*—Robert L. King

[57] ABSTRACT

A display driver system having a plurality of series-coupled display drivers which are synchronized by using the same conductor between adjacent display drivers for communicating display data and synchronization control signals. The display driver serially receives display information at a predetermined clock rate. One of the display drivers becomes a master over the remaining display drivers and provides synchronization data for the system. Each display driver selectively outputs either display information or control information at a single output terminal.

10 Claims, 4 Drawing Sheets

-PRIOR ART-

40
SERIAL OUT
53
55
SYNC SELECTOR
CLOCK
DISPLAY COUNTER
RESET
57
54
ON-CHIP OSCILLATOR
DELAY
56
5
5
67
48
47
DATA OUT
SHIFT REGISTER
DATA IN
CLOCK
50
DISPLAY REGISTER
40
40
40
8
49
CONFIGURATION REGISTER
59
SEGMENT MULTIPLEXOR
8
61
SEGMENT DRIVERS
8
5
46
52
45
51
STEERING CONTROL
58
BLANK DISPLAY LOGIC
5
60
BANK SELECTS
5
SERIAL IN
DATA CLOCK
ENABLE

SYNCHRONIZATION METHOD AND CIRCUIT FOR DISPLAY DRIVERS

TECHNICAL FIELD

This invention relates to electronic display drivers, and more particularly, to a method and circuit for synchronizing display refresh rates of a plurality of display drivers.

BACKGROUND OF THE INVENTION

Various display drivers exist for controlling and driving a large class of electronic display devices, such as liquid crystal displays (LCDs), light emitting diodes (LEDs), and vacuum flourescent displays (VFDs). As a family of devices, these display drivers can be configured to accommodate many different applications. For example, commercially available LED display drivers can interface to individual lamps, to seven-segment LED displays, or to combinations of both. Furthermore, display drivers are often capable of retaining data, thereby reducing control overhead. Despite design enhancements, single display drivers are often constrained by a limited number of output terminals per display driver. As a result, display drivers are commonly cascaded to expand drive capacity when driving large electronic displays with many display elements. To further increase drive capacity, display data is multiplexed onto the output terminals.

As an example of previous techniques for increasing drive capacity, consider a driver display having a ten digit, seven segments per digit, LED display. In one previous system, the LED display is driven by a single display driver which contains seventy output terminals. However, the single display driver has an inordinately high package pin count and is cost effective only in very large displays. By applying cascading techniques, the LED display can be driven in a second known system by ten separate display drivers, each driver containing seven output terminals. This second system has an added advantage of employing smaller display drivers which are cheaper to manufacture and which have increased display flexibility when driving smaller displays. By further employing multiplexing techniques in addition to the cascading technique of the second mentioned system, the LED display can be driven in a third known system by two display drivers. Each display driver contains seven output terminals which are driven in a multiplexed by five fashion. If the multiplex or display refresh rate is sufficiently fast to escape human visual detection, the ten digit LED display appears to be driven continuously. Thus, by employing multiplexing and cascading techniques, large displays with many display elements have been driven by a relatively small number of display driver devices.

For proper operation, cascaded chains of display drivers must interface with a control unit, most likely a microprocessor or microcontroller, in order to load new display data. Further, in display systems which employ cascading to increase display capacity, data display refresh rates of individual display drivers must be synchronized prior to displaying data. This synchronization process has been accomplished by circuitry either internal or external to the display drivers.

A known synchronization technique which minimizes the number of control lines and allows limited autonomy in the cascaded display driver system utilizes a synchronous serial interface. In this technique, each display driver is connected to the control unit via an enable input and a data clock signal, while communication occurs between display drivers through both data out/in signals and a synchronization signal in separate signal paths. Generally, display data is loaded into the cascaded display driver chain by the control unit during an initial configuration period, followed by independent operation of the cascaded display drivers. During independent operation, data from internal display registers are placed on the output terminals and driven onto the display array. Synchronization of individual display driver rates occurs through a dedicated synchronization signal which is fed into all display driver devices.

In the aforementioned synchronization technique, five control signals are required to implement the synchronous serial interface. In medium sized packages of approximately twenty pins, the manufacturing cost for five control signals becomes prohibitively large due to a direct relationship between pins per device and packaging costs. Continued cost reduction of display drivers has become paramount because display drivers are typically high volume, low cost devices.

SUMMARY OF THE INVENTION

Accordingly, it is an object of the instant invention to provide an improved synchronization method and circuit for display drivers.

Another object of the instant invention is to provide an improved, cost effective method and circuit for implementing a synchronous serial interface in cascaded display display driver systems.

In carrying out the above and other objects of the present invention, there is provided, in one form, a circuit and method which reduces the number of control signals and conductors (i.e. control lines) required to synchronize cascaded display driver devices. Both synchronization and data signals are multiplexed on a single conductor. A plurality of display driver devices are cascaded in series wherein each display driver device has an output terminal and an input terminal. Serial information is received at an input terminal of a predetermined one of the display driver devices. A control signal is also generated by the predetermined one of the display driver devices. One of either the serial information or the control signal is selected to be outputted at the output terminal of the predetermined display driver device. Substantially the same steps of receiving serial data, generating a control signal and selecting one of data or the control signal are then repeated in all remaining cascaded display driver devices in a sequential order.

These and other objects, features and advantages, will be more clearly understood from the following detailed description taken in conjunction with the accompanying drawings.

DETAILED DESCRIPTION OF THE INVENTION

Figure 1:
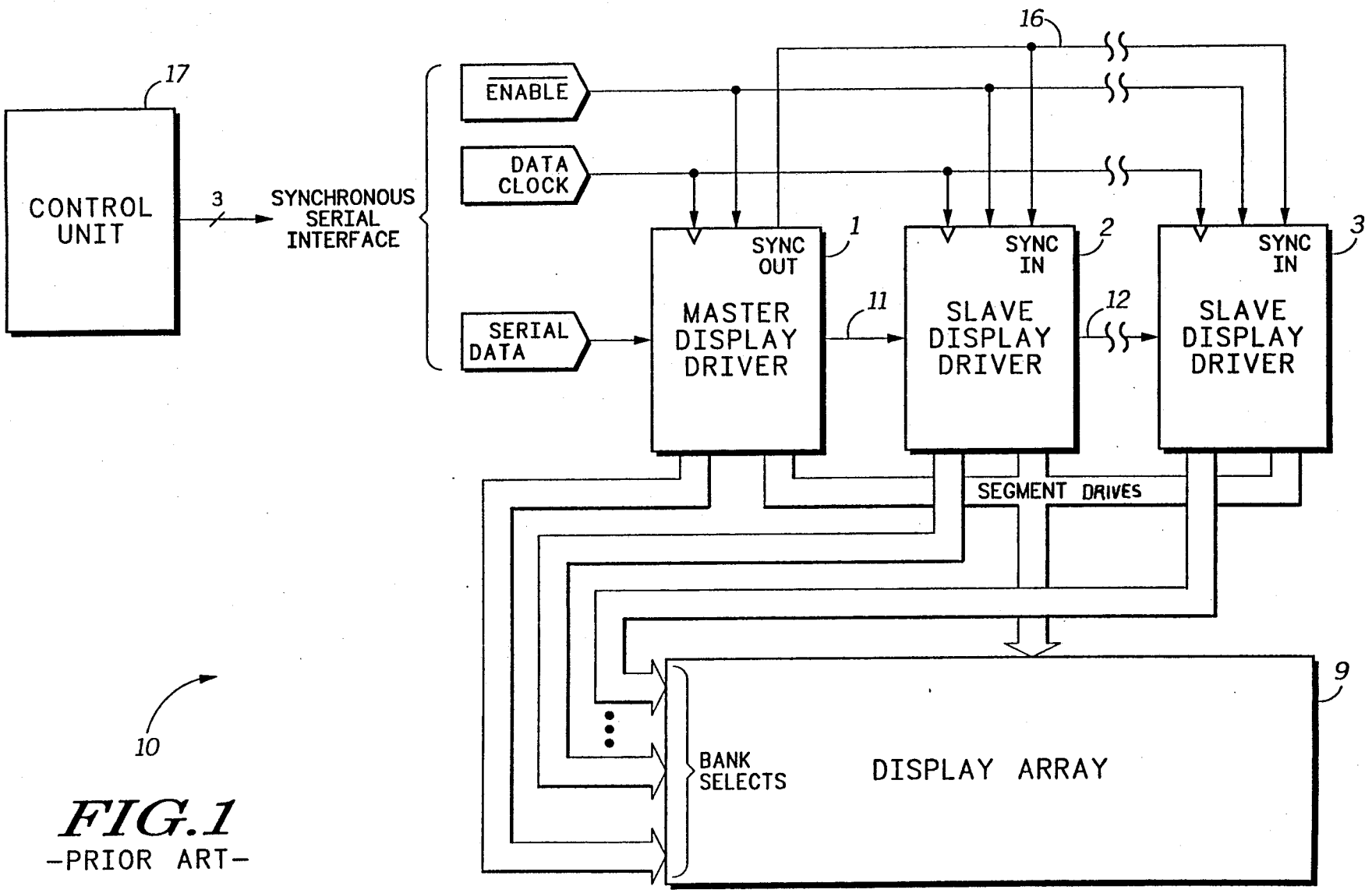
FIG. 1 is a block diagram illustrating a known circuit for synchronizing a plurality of cascaded display drivers.

Shown in FIG. 1 is a known display system 10, generally comprising a display array 9, a master display driver 1, a pair of slave display drivers 2 and 3, and a control unit 17 which communicates with a synchronous serial interface. In the illustrated form, the synchronous serial interface connects control unit 17 to a data clock signal, to a complement enable signal, and to a serial data signal. Master display driver 1 communicates directly with control unit 17 via the synchronous serial interface, while slave display drivers 2 and 3 are cascaded after master display driver 1 to increase the number of output signals driven by the system. Additional slave display drivers may be added to the system as noted by the broken lines in FIG. 1. The data clock signal is connected to a clock input of each of display drivers 1, 2 and 3. The complement enable signal is connected to an enable input of each of display drivers 1, 2 and 3. A data input of display driver 1 is connected to the serial data signal of the synchronous serial interface. A data output of display driver 1 is connected to a data input of display driver 2 by a serial data line 11. A data output of display driver 2 is connected to a data input of display driver 3. A synchronization output signal of master display driver 1 is connected to synchronization input terminals of each of slave display drivers 2 and 3 via a synchronization line 16. Each of display drivers 1, 2 and 3 provides a segment drive output signal and a bank select output signal to appropriate inputs of display array 9.

Display system 10 illustrates a known technique for cascading and synchronizing two or more display drivers. During operation, display data is initially shifted into master display driver 1 through the serial data input terminal, and then shifted into the following slave display drivers 2 and 3 through serial data lines 11 and 12. The shifting process is controlled by the complement enable and data clock signals of the synchronous serial interface. Upon successful loading of the new display data, master display driver 1 generates a synchronization signal which is received by all slave display drivers. The synchronization signal is required to ensure synchronous operation of the slave display driver or drivers with the master display driver. Following synchronization, display data is multiplexed from display drivers 1, 2 and 3 onto a segment drive bus in response to synchronization signal 16. Coupled via the segment drive bus, the display data drives display array 9, while the bank select output signals provided by drivers 1, 2 and 3 select the appropriate display bank or digit to be driven. It should be noted that display system 10 requires dedicated output terminals or circuit pins for the synchronization information which is communicated between display drivers 1, 2 and 3 by synchronization line 16. Also, master display driver 1 is different from slave display drivers 2 and 3.

Figure 2:
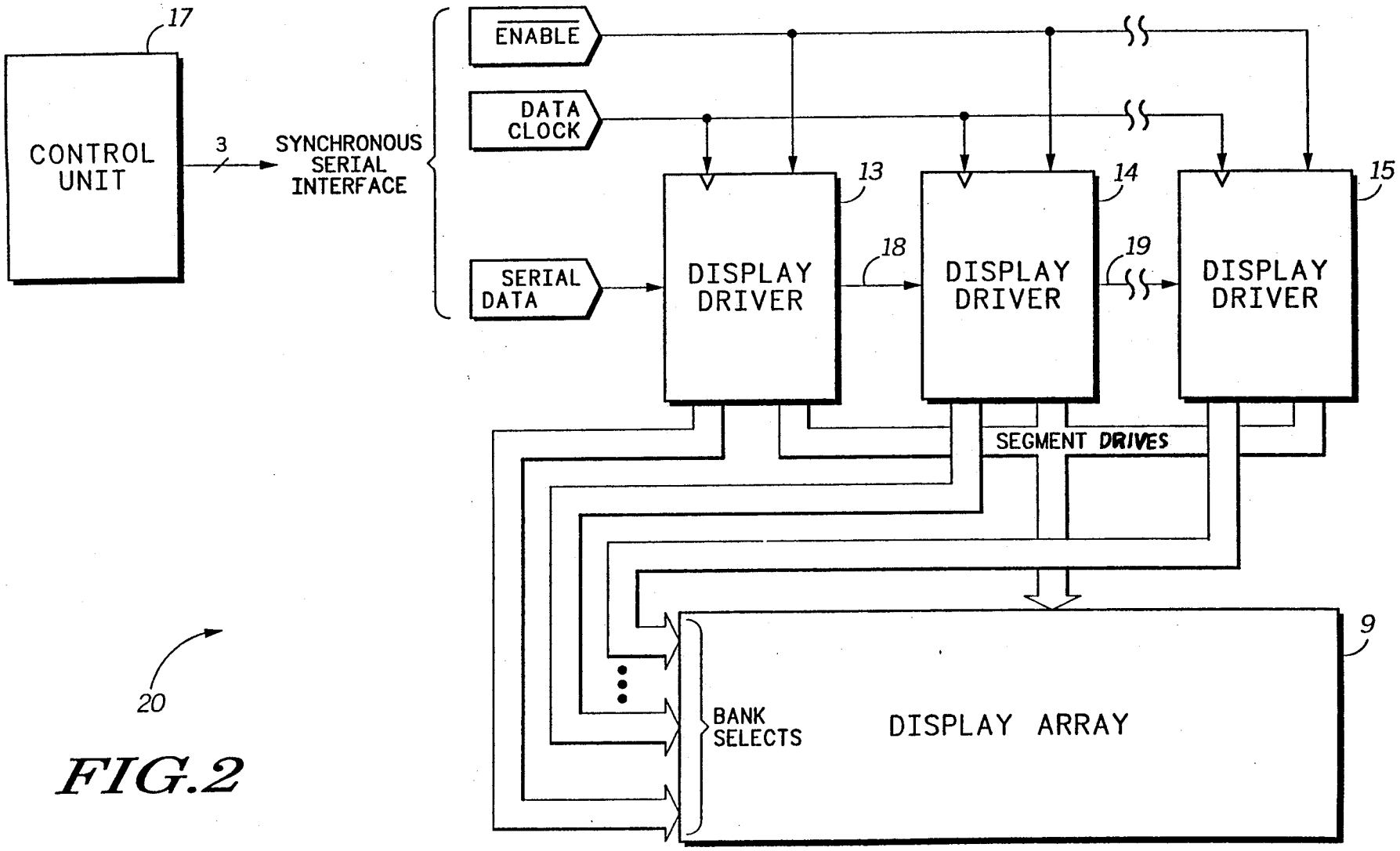
FIG. 2 is a block diagram illustrating a system for synchronizing a plurality of cascaded display drivers in accordance with the present invention.

Shown in FIG. 2 is a display system 20 in accordance with the present invention. For convenience of comparison with display system 10, identical control unit 17 and display array 9 are utilized. The synchronous serial interface again comprises a complement enable signal, a data clock signal and a serial data signal. Display drivers 13, 14 and 15 are cascaded in series. The data clock signal is connected to a clock input terminal of each of display drivers 13, 14 and 15. The complement enable signal is connected to an enable input terminal of each of display drivers 13, 14 and 15. The serial data signal is connected to a data input terminal of display driver 13. A data output terminal of display driver 13 is connected to a data input terminal of display driver 14 via a conductor 18. A data output terminal of display driver 14 is connected to a data input terminal of display driver 15 via a conductor 19. Each of display drivers 13, 14 and 15 provide multiplexed display information via a segment drive bus and a bank or digit select signal via bank select lines to display array 9 as was illustrated in FIG. 1. It should be noted that master display driver 1 and slave display drivers 2 and 3 of FIG. 1 have been replaced with display drivers 13, 14, and 15 which are uniform in structure. Again it should be noted that only three cascaded display drivers are illustrated, but any plurality of display drivers may be used when implementing the present invention.

Figure 3:
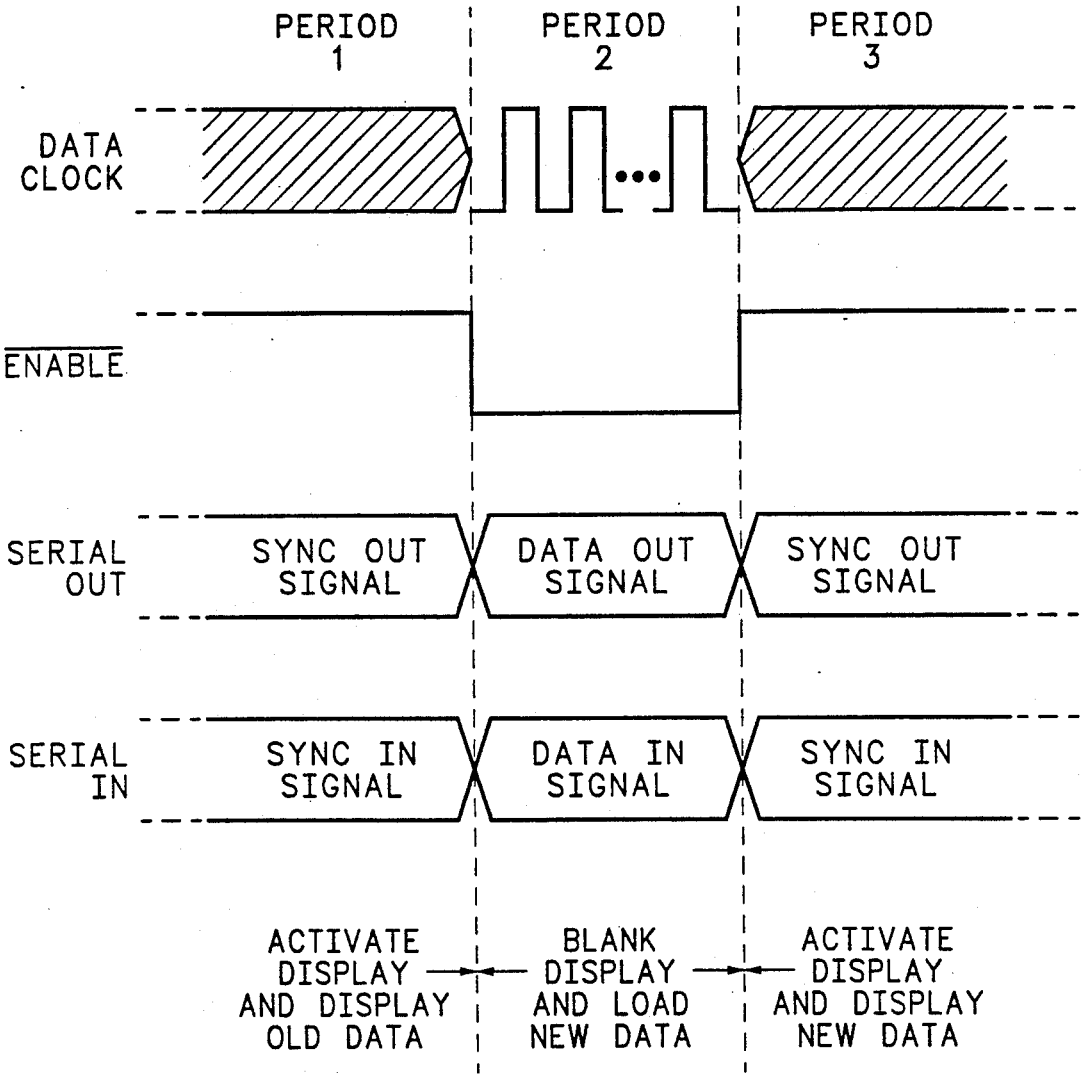
FIG. 3 is a timing diagram illustrating the operation of the system of FIG. 2.

A timing diagram in FIG. 3 illustrates a multiplexing scheme which the present invention utilizes. Shown in the timing diagram are control signals data clock and complement enable from the synchronous serial interface and the serial-in serial input and serial-out serial output terminals of any one of the cascaded display drivers 13, 14 and 15 of FIG. 2. The illustrated operation has three distinct time periods for accomplishing three distinct functions as labeled in FIG. 3. When the complement enable signal is a logic high, as shown in time period one, a synchronization signal is outputted at the serial-out serial output terminal of the appropriate display driver, and a synchronization signal is received at the serial-in serial input terminal. This first time period corresponds to a first data display mode of operation wherein a synchronization signal is generated in display driver 13 of FIG. 2, and propagated along the chain of display drivers 14 and 15 through appropriate serial-out serial output and serial-in serial input terminals. Conductors 18 and 19 additionally function as synchronization lines which coordinate the display refresh rates of individual display drivers. The data clock signal is not used during this first mode of operation, and the hatched area indicates a "don't care" region wherein the value of the data clock signal is immaterial. In time period two, when the complement enable signal is a logic low, conductors 18 and 19 switch modes and function as serial data lines connecting cascaded display drivers. This second time period corresponds to a data load mode of operation wherein serial data is received from control unit 17 at the serial input terminal of display driver 13 and propagated to display drivers 14 and 15 through conductors 18 and 19, respectively. The data clock signal is now employed as a timing control signal for the data load mode of operation. During this second mode of operation, the display is placed in an inactive state as new display data replaces old display data. However, for sufficiently high clock rates the blanking of display array 9 is not visually noticeable. Upon completion of data loading, the complement enable signal is returned to a high logic level in time period three, which implements a return to a data display mode of operation. As in time period one, the hatched area for the data clock in time period three indicates a "don't care" region for the data clock signal. Synchronization signals are again placed on conductors 18 and 19 to coordinate display refresh rates, as the display is reactivated to display new data.

Although display systems 10 and 20 are substantially the same in functionality, the known synchronization method illustrated by display system 10 in FIG. 1, has a number of disadvantage overcome by the present invention. At this point, the significant improvements realized with the synchronization technique of display system 20 of FIG. 2, will be discussed.

Firstly, the synchronization method of display system 10 may require two types of display units, a master unit and a slave unit, which results in a duplication of manufacturing efforts and increased costs. In the synchronization method of display system 20 all driver units are uniform in structure, thereby reducing manufacturing costs. Secondly, the synchronization technique of display system 10 is more expensive to implement with display drivers that contain a relatively small number of output terminals. For example, consider a conventional forty pixel vacuum flourescent display (VFD) driver implemented in a multiplex-by-five fashion. The conventional display driver requires eight terminals for the multiplexed anode drive lines, five terminals for the grid drive lines, three terminals for power, and five terminals for the synchronous serial interface, resulting in a total of twenty-one terminals. A twenty-two pin package would have to be employed to package the VFD display driver since integrated circuit packages do not typically have an odd number of pins. By applying the instant invention, one control line can be eliminated from the synchronous serial interface, and hence, a cheaper and smaller twenty pin package can be employed. Moreover, surface-mount twenty pin packages are more readily available than twenty-two pin surface-mount packages. An additional benefit of increased drive capability is provided by the present invention. For example, with a twenty pin package, drive capability is limited to only thirty-two pixels with known techniques. With the instant invention in the same twenty pin package, drive capability can be increased to forty pixels.

Figure 4:
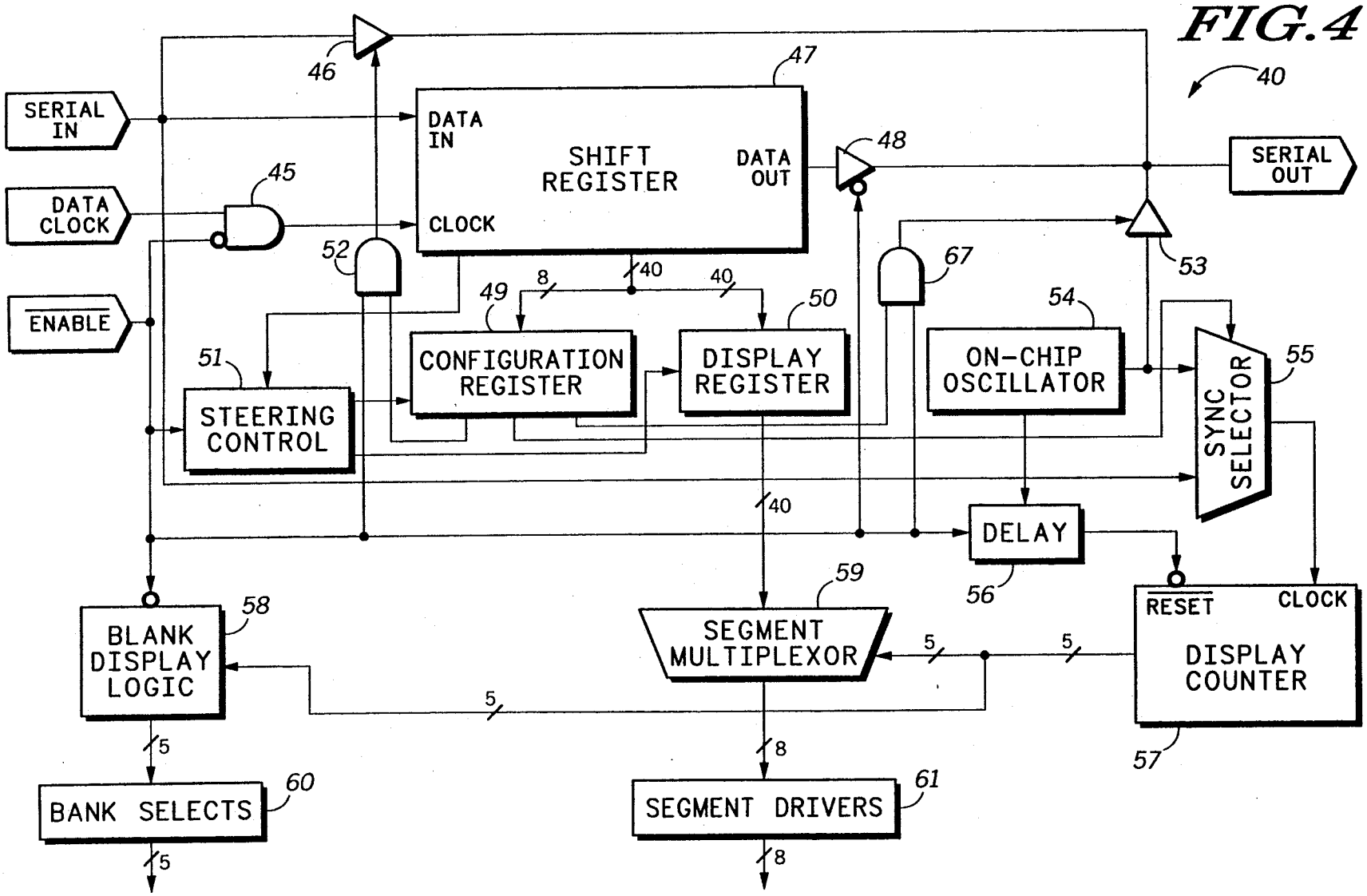
FIG. 4 is a block diagram illustrating in further detail a display driver shown in the system of FIG. 2.

Shown in FIG. 4 is a block diagram of a display driver 40, illustrating in accordance with the present invention the synchronization and display circuitry as implemented in a display driver, such as any of display drivers 13, 14 or 15 of FIG. 2, with eight outputs, or segment drivers, and five bank selects. Although the width of appropriate registers and signal busses are specified in the diagram, implementations of the instant invention are in no way limited to the specific bit sizes of driver system 40.

A data clock input is connected to a first input of an AND gate 45, and a complement enable signal is connected to a complement second input of AND gate 45. A serial-in terminal for receiving data serially is connected to both an input of a three-state buffer 46 and to a data input of a shift register 47. An output of AND gate 45 is connected to a clock input of shift register 47. A data output of shift register 47 is connected to an input of a three-state buffer 48. An output of each of buffers 46 and 48 is connected to a serial output terminal. A forty bit wide display output of shift register 47 has eight bits of the forty connected to an input of a configuration register 49 and all forty bits connected to an input of a display register 50. A control output bit of shift register 47 is connected to a first input of a steering control circuit 51. The complement enable signal is connected to a second input of steering control circuit 51. Steering control circuit 51 has a first output which functions as a load enable signal connected to a second input of configuration register 49, and has a second output which also functions as a load enable signal connected to a second input of display register 50. The second input of configuration register 49 and the second input of display register 50 receive load input signals. The complement enable signal is further connected to a first input of an AND gate 52. A first output of configuration register 49 is connected to a second input of AND gate 52. An output of AND gate 52 is connected to a control input of three-state buffer 46. A three-state buffer 53 has an output connected to the serial output terminal. An on-chip oscillator 54 has a first, or low frequency, output connected to both a first input of a synchronization selector 55 and to an input of three-state buffer 53, and has a second, or high frequency, output connected to a control input of a delay circuit 56. The complement enable signal is also connected to an input of delay circuit 56, and an output of delay circuit 56 is connected to a complement reset input of a display counter 57. An output of display counter 57 is connected to a control input of a blank display logic circuit 58, to a control input of a segment multiplexor 59, and to a first input of position logic 62. A complement input of blank display logic circuit 58 is connected to the complement enable signal, and an output of blank display logic circuit 58 is connected to an input of a bank selects circuit 60 for providing bank select signals. An output of segment multiplexor 59 is connected to an input of segment drivers 61. An output of segment drivers 61 provides the drive signals for the segments of the display. A second output of configuration register 49 is connected to a control input of synchronization selector 55 and a second input of position logic 62. A second input of synchronization selector 55 is connected to the serial-in terminal. An output of synchronization selector 55 is connected to a clock input of display counter 57. A third output of configuration register 49 is connected to a first input of an AND gate 67, and a fourth output of configuration register 49 is connected to a third input of position logic 62. A first output of position logic 62 is connected to an input of blank display logic 58, and a second output of position logic 62 is connected to a control input of segment drivers 61. The complement enable signal is also connected to a control input of three-state buffer 48 and a second input of AND gate 67.

As previously discussed, an active mode and blank display mode of operation exist for display driver 40 depending on the value of the complement enable signal. If the complement enable is inactive high, display driver 40 operates as a synchronized driver circuit controlling the display of a display array such as display array 9. If the complement enable is active low, display driver 40 operates as a shift register under the supervision of a control unit such as control unit 17. First consider the case when the complement enable signal is active low and serial data propagates through the serial-in and serial-out terminals, as illustrated in time period two of the timing diagram in FIG. 3. Assuming a valid clock signal has been placed on the data clock input terminal, the output of AND gate 45 will be identical to the data clock. Shift register 47 will begin to load and shift new data from the serial data in terminal at a rate established by the data clock. Additionally, three-state buffer 48 is activated by the complement enable signal, and the output of shift register 47 will be serially shifted into an analogous shift register of a subsequent cascaded driver circuit. Thus, data from control unit 17 can be serially transferred through a chain of series coupled display drivers configured as display driver 40. During the second time period of operation shown in FIG. 3, three-state buffers 46 and 53 must be placed in a high-impedance state to prevent data corruption. As can be seen, three-state buffers 46 and 53 are controlled by the outputs of AND gates 52 and 67 respectively, which are both guaranteed low if the complement enable signal is low.

In display driver 40, data from shift register 47 can be loaded in parallel to either configuration register 49 or display register 50. Following the data loading mode of operation, forty bits can be stored in display register 50 if the data in shift register 47 corresponds to display data. If the data corresponds to configuration data, then eight bits can be stored in configuration register 49. The size of configuration register 49 can be made as small or as large as required for the particular implementation, while a lower limit to the width of display register 50 is generally fixed by the number of segment drivers and the number of bank selects in the driver system. Steering control circuit 51 regulates, or steers, data from shift register 47 into either configuration register 49 or display register 50. Outputs from steering control circuit 51 correspond to load signals which force configuration register 49 to latch configuration data or display register 50 to latch display data. The inputs to steering control circuit 51 are the complement enable signal and a control bit from shift register 47.

During the data loading process of the second time period, driver system 40 cannot function as the display array controller. Therefore, blank display logic circuit 58 provides a mechanism for blanking the display array whenever the complement enable signal is active low. The complement enable signal and outputs from display counter 57 are the inputs to blank display logic 58, and its outputs are coupled to bank selects circuit 60.

The activity of the remainder of display driver 40 is not relevant to system functionality during the data load mode of operation in the second time period. By the operation of three-state buffer 53, the output of on-chip oscillator 54 is effectively isolated from the serial-out terminal. Blank display logic 58 functions to make the activity of segment drivers 61, segment multiplexor 59, display counter 57, position logic 62, and synchronization selector 55 not affect the display output during the data load mode of operation.

Alternately, consider the circuit operation when the complement enable signal is inactive high and a synchronization signal propagates through the serial-in and serial-out terminals of display driver 40, as illustrated during time periods one and three of FIG. 3. In this mode of operation, the output of AND gate 45 is guaranteed to be a logic low and hence, shift register 47 does not shift data. Synchronization is provided by either on-chip oscillator circuit 54 or an external synchronization signal (not shown) coupled to the serial-in terminal. Display driver 40 can use synchronization selector 55 to select either signal to synchronize the display refresh rate. A first configurable control bit from the second output of configuration register 49 is responsible for selecting the synchronization signal outputted by synchronization selector circuit 55.

Selection of the on-chip oscillator signal as the synchronization signal corresponds to operation of the particular display driver device as the master unit over other coupled display driver devices. If this is the case, all subsequent cascaded display drivers function as slave units, selecting external synchronization signals from the master unit. Additionally, three-state buffer 46 is activated in all slave units to create a propagation path from the serial-in input terminal to the serial-out output terminal. Furthermore, three-state buffer 53 is not activated in order to isolate on-chip oscillator 54 from the serial-out output terminal. For the master unit, the opposite is true. Three-state buffer 46 is placed in a high impedance state, and three-state buffer 53 is activated to provide a synchronization signal from on-chip oscillator 54. Second and third configurable control bits from configuration register 49 determine whether a predetermined driver system is designated a master unit or a slave unit. The control bits are respectively coupled from the first and third outputs of configuration register 49 to AND gates 52 and 67 to control three-state buffers 46 and 53, respectively.

Regardless of the function of driver system 40 as a master unit or a slave unit, synchronization of its display refresh rate with other cascaded driver systems occurs upon the transition of the complement enable signal from active low to inactive high. In order to allow time for synchronization signals to propagate and settle through all driver systems, the transition of the complement enable signal is delayed by delay circuit 56. While the complement enable signal is active low, display counter 57 is placed in a reset mode, but upon the transition of the complement enable signal to inactive high, display counter 57 begins counting at a rate determined by its clock input. Assuming all drivers, such as display driver 40, in the series coupled display drive chain are configured as shown in FIG. 4, individual display counters on each display driver will begin counting at the same time, and at the same rate, thereby operating synchronously. In display driver 40, outputs from display counter 57 comprise five select lines which are coupled to segment multiplexor 59 and blank display logic 58. The five select lines function to select the appropriate bank, or display digit. Additionally, the five select lines control the multiplex rate of segment multiplexor 59 as multiplexor 59 cycles through eight-bit sections of the forty-bit display data word stored in display register 50. In the illustrated form, synchronous operation of individual segment multiplexors on separate display drivers can be guaranteed, thereby ensuring fully synchronous operation of the entire display system.

Position logic 62 functions to identify the position of the display driver in a series-coupled display driver chain. Two configuration bits from the fourth output of configuration register 49 identify up to four positions: first, second, third, or fourth. A third configuration bit from the second output of configuration register 49 identifies the display driver as a master or slave unit. During the data display mode of operation, position logic 62 implemented with conventional logic determines the appropriate time frame for segment drivers 61 and bank selects circuit 60 to drive the display array. For example, in a three driver cascaded system, individual display drivers are configured as the first, second, or third display driver according to the order in which they are cascaded. Based on this information which is stored in configuration register 49, the position logic circuitry on the first display driver then determines that the first display driver drives the display array during a first time frame, and similarly, the second and third display drivers drive the display array during a second and a third time frame. Similarly, in position logic circuitry in each slave display driver, consistent information is stored for proper synchronized operation. The length of the time frame is determined by the number of bank selects outputs per display driver.

By now it should be apparent that a display driver circuit and a method have been provided for efficiently synchronizing the display refresh rates of a plurality of cascaded display drivers. The present invention simplifies the control circuitry associated with previously known synchronized display systems, thereby resulting in improved manufacturing efficiencies.

While there have been described above the principles of the invention, it is to be clearly understood to those skilled in the art that this description is made only by way of example and not as a limitation to the scope of the invention. Accordingly, it is intended, by the appended claims, to cover all modifications of the invention which fall within the true spirit and scope of the invention.

I claim:

1. A method for communicating signals between a plurality of display driver devices comprising the steps of:

(1) cascading the plurality of display driver devices in series wherein each display driver device comprises an output terminal and an input terminal;

(2) receiving serial information at an input terminal of a first predetermined one of the display driver devices;

(3) outputting the serial information at an output terminal of the first predetermined one of the display driver devices; and (4) sequentially repeating steps (2) and (3) in all remaining cascaded display driver devices, thereby loading data in all of the display driver devices;

(5) generating a control signal in the first predetermined one of the display driver devices;

(6) selecting the control signal rather than the serial information to output at the output terminal of the first predetermined one of the display driver devices;

(7) receiving the control signal at a serial input terminal of a series-coupled display driver device which is adjacent the first predetermined one of the display driver devices;

(8) outputting the control signal at the output terminal of the adjacent series-coupled display driver device; and (9) sequentially repeating steps (7) and (8) until the control signal is propagated through all remaining series-coupled display driver devices, thereby allowing the loaded data to be displayed by all of the display driver devices.

2. The method of claim 1 wherein the control signal is a synchronization signal used to synchronize the display refresh rates of multiplexed display data.

3. The method of claim 1 wherein the serial information contains configuration data to control the operation of the series-coupled chain of display driver devices.

4. The method of claim 1 wherein the serial information contains display data to be driven by the series-coupled chain of display driver devices.

5. The method of claim 1 wherein the serial information is a synchronization signal which is propagated through the series-coupled display driver devices in order to synchronize multiplexed display refresh rates of the plurality of display driver devices.

6. A method for operating a plurality of display driver devices comprising the steps of:

cascading the plurality of display driver devices in series wherein each display driver device comprises a serial output terminal and a serial input terminal;

performing a data load mode of operation in each of the plurality of display driver devices by:

(a) receiving serial data at the serial input terminal of a first predetermined one of the display driver devices;

(b) outputting the serial data at a serial output terminal of the predetermined one of the display driver devices; and (c) sequentially repeating steps (a) and (b) for all remaining display driver devices until the serial data has propagated through all cascaded display driver devices; and performing a data display mode of operation in the plurality of display driver devices by:

(a) generating a synchronization signal in a second predetermined one of the display driver devices;

(b) selecting the synchronization signal rather than serial data to be outputted at the same serial output terminal of the second predetermined display driver device where said serial data was outputted during the data load mode of operation;

(c) receiving the synchronization signal at a serial input terminal of an adjacent series-coupled display driver device;

(d) selecting the synchronization signal rather than serial data to be outputted at the same serial output terminal of the adjacent series-coupled display driver device where said serial data was outputted during the data load mode of operation; and (e) sequentially repeating steps (c) and (d) until the synchronization signal is propagated through all remaining series-coupled display driver devices.

7. The method set forth in claim 6 wherein a plurality of data load modes of operation and data display modes of operation are performed.

8. The method set forth in claim 6 wherein the synchronization signal in the first display driver device during the data display mode of operation is received at the serial input terminal of the adjacent series-coupled display driver device from an external source.

9. A display driver system of claim 6 wherein the first predetermined and second predetermined display driver devices are the same display driver device.

10. A display driver system having a serial input terminal for receiving serial information, a clock input terminal for receiving a clock signal, a control input terminal for receiving a control signal, and a serial output terminal for outputting serial information, the display driver system comprising:

a shift register having a control input coupled to the clock input terminal, a serial data input coupled to the serial input terminal, a serial data output coupled to the serial output terminal, a control output, and an output for outputting the contents of the shift register, the control input enabling shifting of data through the shift register;

control logic having a first control input coupled to the control output of the shift register, a second control input coupled to the control input terminal, a first output, and a second output, the control logic outputting signals at the first and second outputs in a predetermined logical response to the first and second control inputs;

a first register having a control input coupled to the first output of the control logic, an input coupled to the output of the shift register, and an output for outputting contents of the first register, the control input enabling loading of configuration data for the display driver system from the shift register into the first register;

a second register having a control input coupled to the second output of the control logic, an input coupled to the output of the shift register, and an output for outputting contents of the second register, the control input enabling loading of display data from the shift register into the second register;

an oscillator means having an output for providing an oscillating signal;

a delay means having an input coupled to the control input terminal of the display driver system, and a delayed output for providing a delayed control signal;

a first multiplexor having an input coupled to the output of the second display register, a select input, and an output for providing display data;

a second multiplexor having a first input coupled to the output of the oscillator means, a second input coupled to the serial input terminal, and a select input coupled to a first predetermined portion of the output of the first register;

a counter having a control input coupled to the output of the delay means, a clock input coupled to the output of the second multiplexor, and an output coupled to the select input of the first multiplexor, the control input performing a counter reset operation;

a first three-state buffer having an input coupled to the serial input terminal, an output coupled to the serial output terminal, and a control input coupled to a first logic control signal responsive to the control signal and a first predetermined portion of the output of the first register;

a second three-state buffer having an input coupled to the serial data output of the shift register, an output coupled to the serial output terminal of the display driver system, and a control input for receiving the control signal; and a third three-state buffer having an input coupled to the output of the oscillator means, an output coupled to the serial output terminal, and a control signal coupled to a second logic control signal responsive to the control signal and a second predetermined portion of the output of the first register.

* * * * *